US005277790A

United States Patent [19]

Morrissey

[11] Patent Number: 5,277,790

[45] Date of Patent: Jan. 11, 1994

[54] NON-CYANIDE ELECTROPLATING SOLUTION FOR GOLD OR ALLOYS THEREOF

[75] Inventor: Ronald J. Morrissey, Cranston, R.I.

[73] Assignee: Technic Incorporated, Cranston, R.I.

[21] Appl. No.: 911,988

[22] Filed: Jul. 10, 1992

[51] Int. Cl.[5] ..... C25D 3/62

[52] U.S. Cl. ..... 205/248; 205/247; 205/250; 205/266; 205/267; 106/1.26; 106/1.13

[58] Field of Search ..... 205/266, 267, 247, 248, 205/250; 106/1.26, 1.13

[56] References Cited

U.S. PATENT DOCUMENTS

| | | | |
|---|---|---|---|
| 3,057,789 | 10/1962 | Smith | 204/46 |
| 3,475,293 | 10/1969 | Haynes et al. | 204/48 |
| 3,666,640 | 5/1972 | Smith | 204/44 |
| 3,776,822 | 12/1973 | Baker | 204/46 |
| 3,898,137 | 8/1975 | Deuber et al. | 205/248 |
| 3,904,493 | 9/1975 | Losi et al. | 205/248 |
| 4,048,023 | 9/1977 | Stevens | 204/44 |
| 4,192,723 | 3/1980 | Laude et al. | 204/43 |
| 4,366,035 | 12/1982 | Wilkinson | 204/44 |
| 4,435,253 | 3/1984 | Baker et al. | 204/43 |
| 4,497,696 | 2/1985 | Shemyakina et al. | 204/46 |
| 4,717,459 | 1/1988 | Nakazawa et al. | 204/43.3 |

FOREIGN PATENT DOCUMENTS 2244437 3/1973 Fed. Rep. of Germany .

*Primary Examiner*—John Niebling
*Assistant Examiner*—Kishor Mayekar
*Attorney, Agent, or Firm*—Ernest V. Linek

[57] ABSTRACT

Disclosed are cyanide free electroplating solutions for gold or alloys thereof; said solutions comprising gold in the form of a soluble sulfite complex, an added source of sulfite and/or bisulfite ion and a supporting electrolyte; and said solutions further comprising both an organic polyamine or mixture of polyamines of molecular weight from about 60 to 50,000, and an aromatic organic nitro compound; wherein the pH of said solutions is below about 6.5.

27 Claims, No Drawings

NON-CYANIDE ELECTROPLATING SOLUTION FOR GOLD OR ALLOYS THEREOF

BACKGROUND OF THE INVENTION

Electroplating solutions containing gold in the form of a soluble sulfite complex have been known since about 1962, see, e.g., Smith, U.S. Pat. No. 3,0059,789. As originally formulated, commercial solutions based on a gold-sulfite complex were stable only at pH values above about 8.0, and in practice were usually operated at pH range of from 9 to 11. In 1969, Meyer et al., in Swiss Patent No. 506,828, reported that in the presence of organic polyamines, notably ethylenediamine, sulfite-based plating solutions for gold-copper alloys could be stabilized at pH values as low as 6.5. More recently, Kikuchi et al., in the 1990 Japanese Kokai Tokkyo Koho JP 02,232,378 (90,232,378), reported a solution containing sodium gold sulfite which was stabilized at pH 8 by the presence of sodium 3-nitrobenzene sulfonate.

Other gold-sulfite complex plating compositions include the following:

Smith et al., U.S. Pat. No. 3,057,789, which discloses a cyanide free electrolytic bath containing a potassium or a sodium gold sulfite complex and disodium ethylenediamine tetracetate.

Smith et al., U.S. Pat. No. 3,666,640, entitled "Gold Plating Bath and Process," which discloses an aqueous bath for electroplating gold, comprising; alkali gold sulfite; an alkali sulfite; an alkali sulfate; a soluble compound of cadmium, copper, nickel, and/or arsenic; and an organic acid chelating agent, wherein the bath contains sufficient acid or alkali to adjust its pH to between 8.5 to 13.

Stevens, U.S. Pat. No. 4,048,023, which discloses a slightly alkaline gold plating solution, free of cyanide and phosphates, containing a sodium gold sulfite complex and a palladosamine chloride complex.

Laude et al., U.S. Pat. No. 4,192,723, which provides an aqueous solution comprising monovalent gold and ammonium sulfite complex.

Wilkinson, U.S. Pat. No. 4,366,035, which described a cyanide-free bath for the electrodeposition of gold alloys comprising an aqueous alkaline mixture of a gold sulfite, a water soluble copper alloying salt or complex, a water soluble palladium alloying salt or complex and an alkali metal sulfite or ammonium sulfite.

Baker et al., U.S. Pat. No. 4,435,253, which provides gold sulfite electroplating solutions comprising an alkali metal or ammonium gold sulfite, a water soluble salt of thallium metal, and a non-hydroxy, non-amino carboxylic acid.

Shemyakina et al., U.S. Pat. No. 4,497,696, which relates to a gold plating electrolyte which comprises the interaction of the reagents; chloroauric acid, salts of alkali metals of ethylenediamine tetraacetic acid, and alkali metal sulfite or ammonium sulfite.

Nakazawa et al., U.S. Pat. No. 4,717,459, which is directed to an electrolytic gold plating solution including a soluble gold salt, a conductivity salt and, in addition, a mixture of a lead compound and a complexing agent.

It is often desirable to operate gold electroplating solutions at pH values lower than neutral; as, for example, in plating on circuitry defined using alkaline-developable photoresists. It is characteristic of sulfite gold plating solutions that for stable operation a slight excess of sulfite ion beyond that required for complexation of the gold should be present in the solution. Additionally, however, the nature of the gold sulfite complex is such that for every ion of gold added to the solution two ions of sulfite are added. When gold is plated out of the solution at alkaline pH the excess sulfite remains, and can become oxidized to sulfate at the anode. Thus the dissolved solids content, and hence the specific gravity of typical sulfite gold plating solutions increases as the solutions are replenished. For certain applications such as high speed plating this characteristic tends to limit the operating lifetime of the solution. Sulfur dioxide begins to be evolved from sulfite-containing solutions at pH values below about 6.5, forming bisulfite ion, which can itself further react to sulfur dioxide and water. If a sulfite gold plating solution could be operated under stable control at pH values below about 6.5, the controlled evolution of sulfur dioxide could be used to remove a portion of the excess sulfite in a manner analogous to that by which excess cyanide is volatilized from acid gold cyanide electroplating systems.

Finally, it is well known in the art that various alloying, brightening and surface-conditioning agents tend to operate best in selective ranges of pH. Extending the operable pH range of sulfite gold plating solutions should thus increase their adaptability for use with such additives.

SUMMARY OF THE INVENTION

In view of the foregoing it is an object of this invention to provide a sulfite gold electroplating solution which is capable of controlled and stable operation at pH values below about 6.5. It is a further object of the invention that deposits from the electroplating solution thus provided should be of acceptable appearance, purity, hardness, ductility and freedom from porosity and other defects. It is yet a further object that the electroplating solution of this invention should be capable of operating in the presence of various alloying and/or brightening agents in such a fashion as to produce alloyed and/or bright gold electrodeposits.

This invention is thus directed to cyanide free gold electroplating solutions and the use thereof, and more particularly to an aqueous solution comprising;

(a) gold in the form of a soluble sulfite complex,
(b) an added source of sulfite and/or bisulfite ion,
(c) a supporting electrolyte;
(d) an organic polyamine or mixture of polyamines of molecular weight from about 60 to 50,000, and
(e) an aromatic organic nitro compound.

In preferred embodiments of this invention, suitable brightening agents and soluble species of suitable alloying metals may be added to the aqueous solution for the purpose of obtaining bright gold or gold alloy electrodeposits.

DETAILED DESCRIPTION OF THE PREFERRED EMBODIMENTS

It has been discovered that electroplating solutions comprising gold in the form of a soluble sulfite complex, together with an added source of sulfite and/or bisulfite ion and a supporting electrolyte for conductivity and pH control, and also containing both an organic polyamine or mixture of polyamines of molecular weight from about 60 to 50,000 and also an aromatic organic nitro compound, are chemically stable and can be operated under acidic pH conditions, particularly at a pH of about 6.5 or less, e.g., 6.0, 5.5, 5.0, 4.5, and as low as 4.0.

At pH values lower than about 6.0, sulfur dioxide is detectable as it is slowly evolved from the solutions at elevated temperatures. This can be compensated for by the periodic addition of sulfite to the solution. The solutions of this invention are stable indefinitely on standing and can be operated under controlled conditions even at relatively high current densities (>30 mA/cm$^2$).

Suitable organic polyamines for the purposes of this invention include alkylene diamines such as ethylenediamine, 1,2- and 1,3-propanediamines, 1,4-butanediamine, (±) cis-1,2 diaminocyclohexane, (±) trans-1,2 diaminocyclohexane and mixtures thereof, (±) cis-1,4 diaminocyclohexane, (±) trans-1,4 diaminocyclohexane and mixtures thereof; polyalkylene polyamines such as diethylenetriamine, triethylenetetramine, tetraethylenepentamine, and the like, polyethyleneimines of molecular weight from about 300 to 10,000, and ethoxylated polyethyleneimines of molecular weight from about 1,000 to 50,000. In general, polyamines of higher molecular weight are more effective as stabilizing agents for the electroplating solutions of this invention, particularly so at lower values of pH. Additionally, the brightness and hardness of electrodeposits from the various solutions appear to increase with increasing molecular weight of the polyamine employed, at least up to molecular weights of around 1,000–2,000.

It is often useful to be able to control the crystalline structure and thus the mechanical properties of gold electrodeposits; and the use of polyamines of various molecular weights and configurations in the electroplating solutions of this invention affords an extremely versatile and flexible means of achieving such control. To this end it is often useful to employ mixtures of various polyamines.

Suitable aromatic organic nitro compounds for the purposes of this invention include nitrobenzene and those water-soluble compounds which are analogous to nitrobenzene. Included are 2-, 3-, and 4- nitrobenzoic acids and the water-soluble salts thereof; 2-, 3-, and 4-nitrophenols; 3- and 4- nitrophthalic acids and their water-soluble salts; 5- nitro isophthalic acid and its water-soluble salts; 2-chloro-4-nitrobenzoic acid and its water-soluble salts; 3-nitrophthalimide, and 4-nitrophthalimide. It will occur to those skilled in the art that further compounds analogous to these might be synthesized and utilized. Effective concentrations of aromatic organic nitro compounds for the purposes of this invention range from about 0.1 gram per liter to the limit of solubility. In general, it has been found that among a series of analogous compounds, the simpler or less-substituted members are effective in smaller concentrations than more complex or more highly substituted members. Thus 3-nitrobenzoic acid and its water-soluble salts are effective for the purpose of this invention at lower concentrations than 4-chloro 3-nitrobenzoic acid or its salts, or 3-nitrophthalic acid or its salts. All, however, are effective in sufficient quantities.

Gold electroplating solutions generally require the presence of a supporting electrolyte, the purposes of which are to provide electrical conductivity and to establish and maintain the solution pH. In the pH range of this invention, salts of relatively weak acids such as phosphoric, citric, succinic, or lactic are effective for these purposes. If alloyed gold electrodeposits are to be obtained, it is useful to incorporate electrolyte materials having a chelating or complexing functionality, so as to improve the solubility of the various alloying metals. For the purposes of this invention, salts of weak polyfunctional acids such as iminodiacetic, nitrolotriacetic, and ethylenediaminetetraacetic, as well as various organophosphonic acids, are particularly useful.

For the purpose of obtaining alloyed gold deposits, suitable alloying metals may be added to the solutions of this invention in the form of various soluble salts or complexed species. Thus silver, for example, can be added in the form of silver nitrate, silver acetate, silver methane sulfonate, or as a succinimide complex as described in U.S. Pat. Nos. 4,126,524 and 4,246,077. Addition of silver compounds to the solution initially produces a white precipitate which redissolves to form a plateable silver species. Iron, cobalt, nickel and copper, each in its divalent state, may be added in the form of sulfate, acetate, citrate, gluconate or other suitable soluble species. Cadmium may be added as the chloride or acetate. Arsenic may be added as arsenious acid or as sodium or potassium arsenite. Antimony in trivalent form may be added in the form of the chloride or the sulfate. Tetravalent tin may be added as sodium or potassium stannate. Divalent lead may be added as the nitrate or the acetate. Palladium may be added as palladosamine chloride, as palladosamine sulfate, as an organopalladium complex as disclosed in U.S. Pat. Nos. 4,278,514 and 4,406,755. Platinum may be added in the form of chloroplatinic acid or its water-soluble salts. Thallium may be added in its monovalent state as the acetate, nitrate, or sulfate. It will occur to those skilled in the art that other additions of soluble metallic species might usefully be made.

The present invention will be further illustrated with reference to the following examples which will aid in the understanding of the present invention, but which are not to be construed as limitations thereof. All percentages reported herein, unless otherwise specified, are percent by weight. All temperatures are expressed in degrees Celsius.

EXAMPLE 1

Sufficient water was used to form one liter of a gold electroplating solution containing the following:

45 grams EDTA (ethylenediaminetetraacetic acid)
8 milliliters ethylenediamine
30 grams sodium sulfite
1 milliliter nitrobenzene
8.2 grams gold in the form of sodium gold sulfite The solution pH was approximately 6.2. A test panel was plated from this solution in a Hull cell for five minutes at one-half ampere at 60° C. A gold electrodeposit was obtained which was semibright-to-bright at current densities from near zero to about 5 mA/cm$^2$.

EXAMPLE 2

A gold electroplating solution was made up as in Example 1 except that in place of nitrobenzene, 2.5 grams of 2-nitrobenzoic acid was used. A test panel was plated from this solution in a Hull cell for 5 minutes at one-half ampere at 60° C. A gold electrodeposit was obtained which was semibright-to-bright at current densities from near zero to about 7.5 mA/cm$^2$.

EXAMPLE 3

A gold electroplating solution was made up as in Example 1 except that in place of nitrobenzene, 1.3 grams of 3-nitrobenzoic acid was used. A test panel was plated from the solution in a Hull cell for 5 minutes at one-half ampere at 60° C. A gold electrodeposit was obtained which was semibright-to-bright at current densities from near zero to about 6 mA/cm$^2$.

EXAMPLE 4

A gold electroplating solution was made up as in Example 1 except that in place of nitrobenzene, 1.3 grams of 4-nitrobenzoic acid was used. A test panel was plated from this solution in a Hull cell for 5 minutes at one-half ampere at 60° C. A gold electrodeposit was obtained which was semibright-to-bright at current densities from near zero to about 5 mA/cm$^2$.

EXAMPLE 5

A gold electroplating solution was made up as in Example 1 except that in place of nitrobenzene, 1.3 grams of 3-nitrobenzenesulfonic acid was used. A test panel was plated from this solution in a Hull cell for 5 minutes at one-half ampere at 60° C. A gold electrodeposit was obtained which was semibright-to-bright at current densities from near zero to about 6 mA/cm$^2$.

EXAMPLE 6

A gold electroplating solution was made up as in Example 1 except that in place of nitrobenzene, 1.3 grams of 3-nitrophenol was used. A test panel was plated from this solution in a Hull cell for 5 minutes at one-half ampere at 60° C. a gold electrodeposit was obtained which was semibright-to-bright at current densities from near zero to about 6 mA/cm$^2$.

EXAMPLE 7

A gold electroplating solution was made up as in Example 1 except that in place of nitrobenzene, 2.5 grams of the potassium salt of 2-chloro 4-nitrobenzoic acid was used. A test panel was plated from this solution in a Hull cell for 5 minutes at one-half ampere at 60° C. A gold electrodeposit was obtained which was semibright-to-bright at current densities from near zero to about 6 mA/cm$^2$.

EXAMPLE 8

A gold electroplating solution was made up as in Example 3 except that in place of ethylenediamine, 10 milliliters of diethylenetriamine was used. A test panel was plated from this solution in a Hull cell for 5 minutes at one-half ampere at 60° C. A gold electrodeposit was obtained which was mirror-bright at current densities from near zero to about 7 mA/cm$^2$.

EXAMPLE 9

A gold electroplating solution was made up as in Example 3 except that in place of ethylenediamine, 12 milliliters of triethylenetetramine was used. A test panel was plated from this solution in a Hull cell for 5 minutes at one-half ampere at 60° C. A gold electrodeposit was obtained which was mirror-bright at current densities from near zero to about 5 mA/cm$^2$, and semibright at current densities from about 5 to about 15 mA/cm$^2$.

EXAMPLE 10

A gold electroplating solution was made up as in Example 3 except that in place of ethylenediamine, 12 milliliters of tetraethylenepentamine was used. A test panel was plated from this solution in a Hull cell for 5 minutes at one-half ampere at 60° C. A gold electrodeposit was obtained which was mirror-bright at current densities from near zero to about 12.5 mA/cm$^2$.

EXAMPLE 11

A gold electroplating solution was made up as in Example 3 except that in place of ethylenediamine, 12 milliliters of (±) trans-1,2 diaminocyclohexane was used. A test panel was plated from this solution in a Hull cell for 5 minutes at one-half ampere at 60° C. A gold electrodeposit was obtained which was mirror-bright at current densities from near zero to about 20 mA/cm$^2$.

EXAMPLE 12

Sufficient water was used to form one liter of a gold electroplating solution containing the following:

70 grams EDTA
10 milliliters tetraethylenepentamine
30 grams sodium sulfite
2.5 grams sodium 3-nitrobenzoate
8.2 grams gold in the form of sodium gold sulfite The solution pH was approximately 4.8. A test panel was plated from this solution in a Hull cell for 5 minutes at one-half ampere at 60° C. A gold electrodeposit was obtained which was mirror-bright at current densities from near zero to about 5 mA/cm$^2$ and semibright at current densities from about 5 to 30 mA/cm$^2$.

EXAMPLE 13

Sufficient water was used to form one liter of a gold electroplating solution containing the following:

70 grams EDTA
10 milliliters polyethyleneimine (approximate average molecular wt. 1200)
30 grams sodium sulfite
2.5 grams sodium 3-nitrobenzoate
8.2 grams gold in the form of sodium gold sulfite The solution pH was approximately 4.1. A test panel was plated from this solution in a Hull cell for minutes at one-half ampere at 60° C. A gold electrodeposit was obtained which was mirror-bright at current densities from near zero to about 20 mA/cm$^2$.

EXAMPLE 14

A gold electroplating solution was made up as in Example 3 but additionally containing 0.5 milliliter of tetraethylenepentamine. A test panel was plated from this solution in a Hull cell for 5 minutes at one-half ampere at 60° C. A gold electrodeposit was obtained which was mirror-bright at current densities from near zero to about 10 mA/cm$^2$.

EXAMPLE 15

A gold electroplating solution was made up as in Example 3 but additionally containing 0.1 milliliter of polyethyleneimine (average molecular weight about 1200). A test panel was plated from this solution in a Hull cell for 5 minutes at one-half ampere at 60° C. A gold electrodeposit was obtained which was mirror-bright at current densities from near zero to about 20 mA/cm$^2$.

EXAMPLE 16

A gold electroplating solution was made up as in Example 3 but additionally containing 0.1 milliliter of an ethoxylated polyethyleneimine of average molecular weight around 50,000. A test panel was plated from this solution in a Hull cell for 5 minutes at one-half ampere at 60° C. A gold electrodeposit was obtained which was mirror-bright at current densities from near zero to about 20 mA/cm$^2$.

EXAMPLE 17

An electroplating solution for alloyed gold deposits was made up as in Example 3 but additionally containing about 30 parts per million of arsenic added in the form of sodium arsenite. A test panel was plated from this solution in a Hull cell for 5 minutes at one-half ampere at 60° C. A gold-arsenic alloy electrodeposit was obtained which was mirror-bright at current densities from near zero to about 20 mA/cm$^2$.

EXAMPLE 18

An electroplating solution for alloyed gold deposits was made up as in Example 3 but additionally containing 1 part per million of thallium added in the form of thallous sulfate. A test panel was plated from this solution in a Hull cell for 5 minutes at one-half ampere at 60° C. A gold-thallium alloy electrodeposit was obtained which was mirror-bright at current densities from near zero to about 20 mA/cm$^2$.

EXAMPLE 19

An electroplating solution for alloyed gold deposits was made up as in Example 3 but additionally containing 30 parts per million of copper added in the form of cupric acetate. A test panel was plated from this solution in a Hull cell for 5 minutes at one-half ampere at 60° C. A gold-copper alloy electrodeposit was obtained which was mirror-bright at current densities from near zero to about 12 mA/cm$^2$.

EXAMPLE 20

An electroplating solution for alloyed gold electrodeposits was made up as in Example 3 but additionally containing 75 parts per million of silver added in the form of silver nitrate. A test panel was plated from this solution in a Hull cell for 5 minutes at one-half ampere at 60° C. A gold-silver alloy electrodeposit was obtained which was mirror-bright at current densities from near zero to about 5 mA/cm$^2$.

EXAMPLE 21

An electroplating solution for alloyed gold electrodeposits was made up as in Example 3 but additionally containing 100 parts per million of antimony added in the form of antimony potassium tartrate. A test panel was plated from this solution in a Hull cell for 5 minutes at one-half ampere at 60° c. A gold-antimony alloy electrodeposit was obtained which was mirror-bright at current densities rom near zero to about 8 mA/cm$^2$.

EXAMPLE 22

An electroplating solution for alloyed gold electrodeposits was made up as in Example 3 but additionally containing 1600 parts per million of palladium added in the form of palladosamine chloride. A test panel was plated from this solution in a Hull cell for 5 minutes at one-half ampere at 38° C. A gold-palladium alloy electrodeposit was obtained which was mirror-bright at current densities from near zero to about 15 mA/cm$^2$.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A cyanide free gold electroplating solution comprising:

(a) gold in the form of a soluble sulfite complex, (b) an added source of sulfite and/or bisulfite ion, (c) a supporting electrolyte;

(d) an organic polyamine or mixture of polyamines of molecular weight from about 60 to 50,000, and (e) an aromatic organic nitro compound;

wherein said electroplating solution has a pH below about 6.5.

2. The electroplating solution of claim 1, wherein the solution has a pH below about 6.0.

3. The electroplating solution of claim 1, wherein the solution has a pH below about 5.5.

4. The electroplating solution of claim 1, wherein the solution has a pH below about 5.0.

5. The electroplating solution of claim 1, wherein the solution has a pH below about 4.5.

6. The electroplating solution of claim 1, wherein the solution has a pH of about 4.0.

7. The electroplating solution of claim 1, wherein the organic polyamine comprises a $C_2$ to $C_6$ alkylene or $C_5$ to $C_6$ cycloalkylene diamine, or mixtures thereof.

8. The electroplating solution of claim 7, wherein the $C_2$ to $C_6$ alkylene or $C_5$ to $C_6$ cycloalkylene diamine is selected from the group consisting of ethylenediamine, 1,2-propanediamine, 1,3-propanediamine, 1,4-butanediamine, cis-1,2diaminocyclohexane, trans-1,2-diaminocyclohexane, trans-1,4-diaminocyclohexane, trans-1,4-diaminocyclohexane, or mixtures thereof.

9. The electroplating solution of claim 1, wherein the organic polyamine comprises a polyalkylene polyamine or mixtures thereof.

10. The electroplating solution of claim 9, wherein the polyalkylene polyamine is selected from the group consisting of diethylenetriamine, triethylenetetramine, tetraethylenepentamine, or mixtures thereof.

11. The electroplating solution of claim 1, wherein the organic polyamine comprises a polyethyleneimine having a molecular weight of from about 300 to about 10,000.

12. The electroplating solution of claim 1, wherein the organic polyamine comprises an ethoxylated polyethyleneimine having a molecular weight of from about 1,000 to about 50,000.

13. The electroplating solution of claim 1, wherein the aromatic organic nitro compound comprises a substituted or unsubstituted nitrobenzene compound or mixture of compounds.

14. The electroplating solution of claim 13, wherein the substituted or unsubstituted nitrobenzene compound is selected from the group consisting of nitrobenzene, 2-, 3-, or 4-nitrobenzoic acid or their water-soluble salts, 2-, 3-, or 4-nitrobenzenesulfonic acid or their water-soluble salts, 2-chloro 4-nitrobenzoic acid or its water-soluble salts, 2-chloro 5-nitrobenzoic acid or its water-soluble salts, 4-chloro 3-nitrobenzoic acid or its water-soluble salts, 2-, 3-, or 4-nitrobenzaldehyde, 2-, 3-, or 4-nitrophenol, or mixtures thereof.

15. The electroplating solution of claim 1 wherein the aromatic organic nitro compound comprises a nitrosubstituted phthalic acid, a water soluble salt thereof, or mixtures thereof.

16. The electroplating solution of claim 15, wherein the nitro-substituted phthalic acid is selected from the group consisting of 3-, or 4-nitrophthalic acid or their water-soluble salts, or mixtures thereof.

17. The electroplating solution of claim 1, wherein the aromatic organic nitro compound comprises a nitro-substituted isophthalic acid, a water soluble salt thereof, or mixtures thereof.

18. The electroplating solution of claim 17, wherein the aromatic organic nitro compound is 5-nitroisophthalic acid or its water-soluble salts, or mixtures thereof.

19. The electroplating solution of claim 1, wherein the aromatic organic nitro compound comprises a nitro-substituted phthalimide.

20. The electroplating solution of claim 19, wherein the nitro-substituted phthalimide is selected from the group consisting of 3- or 4-nitrophthalimide, or mixtures thereof.

21. The electroplating solution of claim 1, which further comprises a soluble species of one or more alloyable metals for the purpose of producing an alloyed gold electrodeposit.

22. The electroplating solution of claim 21, wherein the alloyable metal is selected from the group consisting of arsenic, thallium, silver, copper, iron, cobalt, nickel, cadmium, antimony, lead, tin, indium, palladium, platinum, or mixtures thereof.

23. The method of electroplating gold or gold alloys on a substrate comprising preparing a cyanide free electroplating solution containing gold in the form of a soluble sulfite complex, an added source of sulfite and/or bisulfite ion, a supporting electrolyte, an organic polyamine or mixture of polyamines characteristics of an organic base, and a molecular weight from about 60 to 50,000, and aromatic organic nitro compound, wherein the solution has a pH of less than 6.5;

and electroplating said gold or gold alloy upon a substrate immersed into said solution.

24. The method of claim 23, wherein the pH of said solution is from about 5.0 to 6.0.

25. The method of claim 23, wherein the pH of said solution is from about 4.0 to 5.0.

26. The method of claim 23, wherein said solution further comprises a soluble compound of one or more gold-alloyable metals.

27. The method of claim 26, wherein said gold-alloyable metal is selected from the group consisting of arsenic, thallium, silver, copper, iron, cobalt, nickel, cadmium, antimony, lead, tin, indium, palladium, platinum, or mixtures thereof.

* * * * *